US007024708B2

(12) United States Patent
Tomas et al.

(10) Patent No.: US 7,024,708 B2
(45) Date of Patent: Apr. 11, 2006

(54) BED RAIL

(75) Inventors: Jorge Tomas, Wrentham, MA (US); Robert D. Monahan, Wakefield, MA (US); Steve Lepke, Wakefield, MA (US)

(73) Assignee: Cosco Management, Inc., Wilmington, DE (US)

( * ) Notice: Subject to any disclaimer, the term of this patent is extended or adjusted under 35 U.S.C. 154(b) by 275 days.

(21) Appl. No.: 10/735,356

(22) Filed: Dec. 12, 2003

(65) Prior Publication Data

US 2004/0211002 A1 Oct. 28, 2004

Related U.S. Application Data

(60) Provisional application No. 60/433,113, filed on Dec. 13, 2002.

(51) Int. Cl.
*A47C 21/08* (2006.01)

(52) U.S. Cl. ..... 5/430; 5/426

(58) Field of Classification Search ..... 5/425–430
See application file for complete search history.

(56) References Cited

U.S. PATENT DOCUMENTS

| | | | | | |
|---|---|---|---|---|---|
| 2,071,155 | A | | 2/1937 | Alexander | |
| 2,649,594 | A | * | 8/1953 | Herz et al. | 5/425 |
| 2,722,693 | A | * | 11/1955 | Wolf | 5/426 |
| 2,751,608 | A | * | 6/1956 | Lucas | 5/426 |
| 3,419,922 | A | | 1/1969 | Malherbe | |
| 3,932,903 | A | | 1/1976 | Adams et al. | |
| 4,178,645 | A | | 12/1979 | Cosme | |
| 4,186,456 | A | | 2/1980 | Huempfner | |
| 4,612,679 | A | | 9/1986 | Mitchell | |
| 4,641,385 | A | | 2/1987 | Peters et al. | |
| 4,747,171 | A | | 5/1988 | Einsele et al. | |
| 5,038,430 | A | | 8/1991 | Bly | |
| 5,394,580 | A | | 3/1995 | Foster et al. | |
| 5,519,905 | A | | 5/1996 | Bernstein et al. | |
| 5,522,100 | A | | 6/1996 | Schilling et al. | |
| 5,577,277 | A | | 11/1996 | Sundberg et al. | |
| 5,640,726 | A | * | 6/1997 | Fichner-Rathus | 5/426 |
| 5,671,490 | A | * | 9/1997 | Wu | 5/426 |
| 5,784,732 | A | | 7/1998 | Vail | |
| 6,021,533 | A | | 2/2000 | Ellis et al. | |
| 6,134,731 | A | * | 10/2000 | Thom et al. | 5/662 |
| 6,289,539 | B1 | * | 9/2001 | Alpern | 5/662 |
| 6,446,283 | B1 | | 9/2002 | Heimbrock et al. | |
| 6,453,490 | B1 | * | 9/2002 | Cardinale | 5/426 |
| 6,725,476 | B1 | * | 4/2004 | Macari | 5/426 |
| 2003/0024047 | A1 | | 2/2003 | Wu | |
| 2004/0040089 | A1 | * | 3/2004 | Flannery et al. | 5/425 |
| 2004/0049849 | A1 | * | 3/2004 | Macari | 5/426 |
| 2004/0154100 | A1 | * | 8/2004 | Macari | 5/426 |
| 2004/0168251 | A1 | * | 9/2004 | Waldman et al. | 5/426 |
| 2004/0187209 | A1 | * | 9/2004 | Flannery et al. | 5/425 |

FOREIGN PATENT DOCUMENTS

| | | | | |
|---|---|---|---|---|
| GB | 2070921 | A | * | 9/1981 |
| GB | 2225716 | A | * | 6/1990 |

* cited by examiner

*Primary Examiner*—Alexander Grosz
(74) *Attorney, Agent, or Firm*—Barnes & Thornburg LLP

(57) ABSTRACT

A bed rail comprises a side rail and a clamp. The clamp is configured to clamp a mattress to mount the side rail alongside the mattress.

28 Claims, 7 Drawing Sheets

BED RAIL

CROSS-REFERENCE

This application claims priority under 35 U.S.C. § 119(e) to U.S. Provisional Application No. 60/433,113, filed Dec. 13, 2002, which is hereby incorporated by reference herein.

Cross-reference is made to co-pending U.S. patent application Ser. No. 10/734,392 entitled "Bed Rail With Clamping Force Indicator" and U.S. patent application No. 10/734,346 entitled "Bed Rail With Fold Controller" each of which is assigned to the same assignee as the present application, is filed concurrently herewith, and is hereby incorporated by reference herein.

BACKGROUND

The present disclosure relates to bed rails. Bed rails are used with beds to help retain individuals in bed.

SUMMARY

According to the present disclosure, a bed rail comprises a side rail and a clamp. The clamp is adapted to clamp a mattress to mount the side rail alongside the mattress.

The clamp includes a fixed jaw, a movable jaw, and a motion controller. The fixed jaw is configured to be positioned in a fixed position under the mattress. The movable jaw is configured to be positioned over the mattress and to move toward and away from the fixed jaw to clamp and unclamp the mattress. The motion controller is configured to control movement of the movable jaw relative to the fixed jaw.

The motion controller includes a ratchet and a ratchet engagement device. The ratchet engagement device is configured to move into engagement with the ratchet to facilitate clamping of the mattress and to release the ratchet to facilitate unclamping of the mattress.

Additional features of the apparatus will become apparent to those skilled in the art upon consideration of the following detailed description exemplifying the best mode of the disclosure as presently perceived.

BRIEF DESCRIPTION OF THE DRAWINGS

The detailed description particularly refers to the accompanying figures in which.

DETAILED DESCRIPTION

Figures 1, 2:
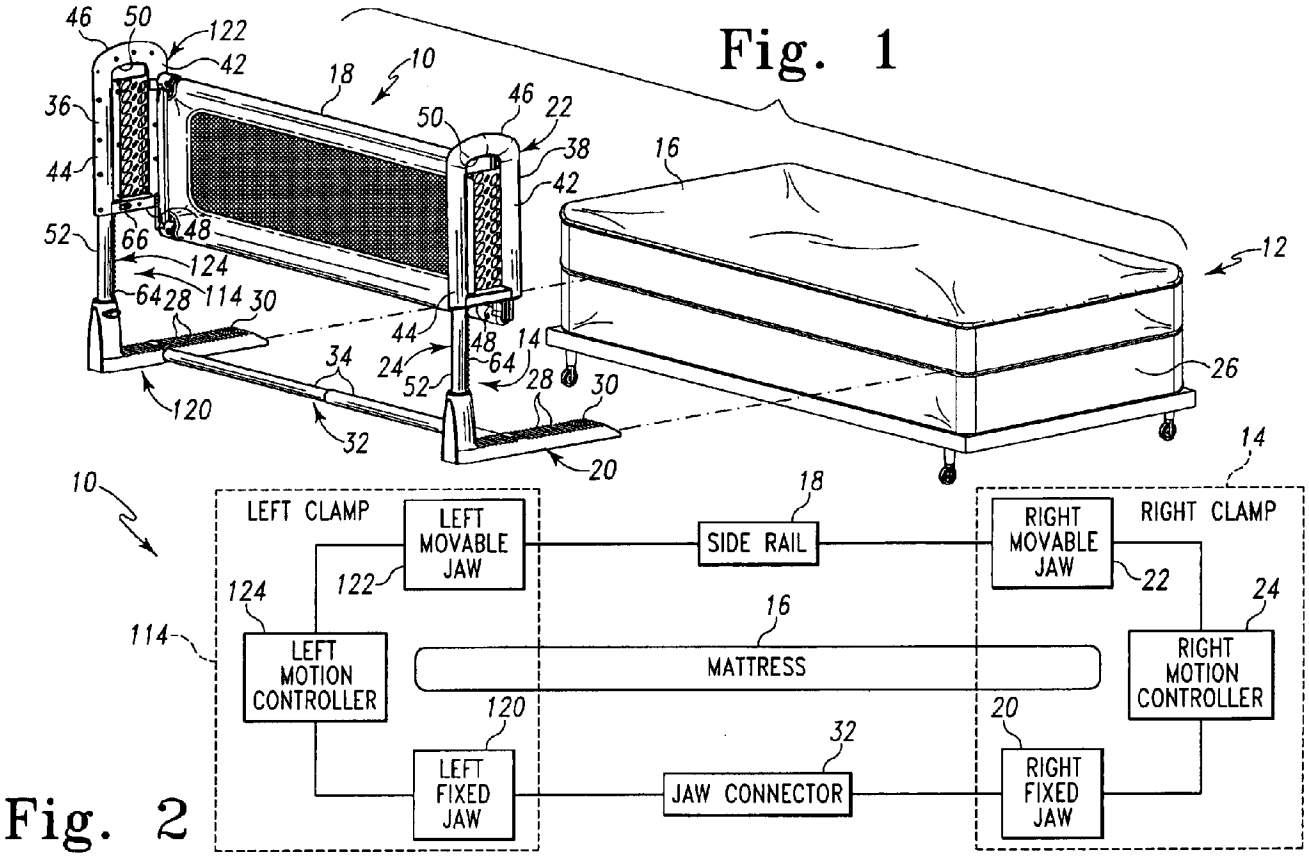
FIG. 1 is a perspective view showing a bed and a bed rail including a side rail positioned between left and right clamps configured to clamp a mattress of the bed to position the side rail alongside the mattress.
FIG. 2 is a diagrammatic view showing components of the bed rail including the left and right clamps and showing each clamp including a fixed jaw configured to be positioned under the mattress, a movable jaw configured to be positioned over the mattress and to move relative to the fixed jaw to clamp the mattress between the fixed jaw and the movable jaw, and a motion controller to control movement of the movable jaw relative to the fixed jaw.

A bed rail 10 is configured for use with a bed 12, as suggested, for example, in FIG. 1. Bed rail 10 may be mounted to bed 12 to inhibit undesired movement of an individual (not shown) out of bed 12. Right and left clamps 14, 114 included in bed rail 10 are configured to clamp a mattress 16 included in bed 12 to mount bed rail 10 to bed 12 and to mount a side rail 18 included in bed rail 10 alongside mattress 16, as discussed in more detail herein. When bed rail 10 is no longer needed, it may be removed from bed 12.

Right clamp 14 includes a right fixed jaw 20, a right movable jaw 22, and a right motion controller 24 and left clamp 114 includes a left fixed jaw 120, a left movable jaw 122, and a left motion controller 124, as shown, for example, diagrammatically in FIG. 2. Fixed jaws 20, 120 are configured to be positioned under mattress 16 in a fixed position between mattress 16 and an underlying box spring unit 26.

Movable jaws 22, 122 are configured to be positioned over mattress 16. Right movable jaw 22 is configured to move toward right fixed jaw 20 to clamp mattress between right fixed jaw 20 and right movable jaw 22 and to move away from right fixed jaw 20 to unclamp mattress 16. Left movable jaw 122 is configured to move toward left fixed jaw 120 to clamp mattress 16 between left fixed jaw 120 and left movable jaw 122 and to move away from left fixed jaw 120 to unclamp mattress 16.

Right motion controller 24 is configured to control relative movement of jaws 20, 22. Right motion controller 24 thus provides motion controller means for controlling relative movement of jaws 20, 22 toward one another to clamp mattress 16 and away from one another to unclamp mattress 16.

Left motion controller 124 is configured to control relative movement of jaws 120, 122. Left motion controller 124 thus provides motion controller means for controlling relative movement of jaws 120, 122 toward one another to clamp mattress 16 and away from one another to unclamp mattress 16.

Right and left clamps 14, 114 are similar to one another in structure and function. Thus, the description herein of right clamp 14 and its components applies also to left clamp 114 and its components.

Fixed jaw 20 is configured to inhibit detachment of bed rail 10 from bed 12. Fixed jaw 20 includes a number ridges 28 formed in a top surface of fixed jaw 20 and an anti-slide member 30 formed to include a number of teeth, as shown, for example, in FIG. 1. Ridges 28 and the teeth of anti-slide member 30 are configured to engage a bottom surface of mattress 16 to inhibit withdrawal of fixed jaw 20 from between mattress 16 and box spring unit 26.

A jaw connector 32 interconnects fixed jaws 20 of left and right clamps 16, as shown, for example, in FIG. 1. In the illustrated embodiment, jaw connector 32 includes telescoping tubes 34 configured to be locked in an extended, use position.

Figure 4:
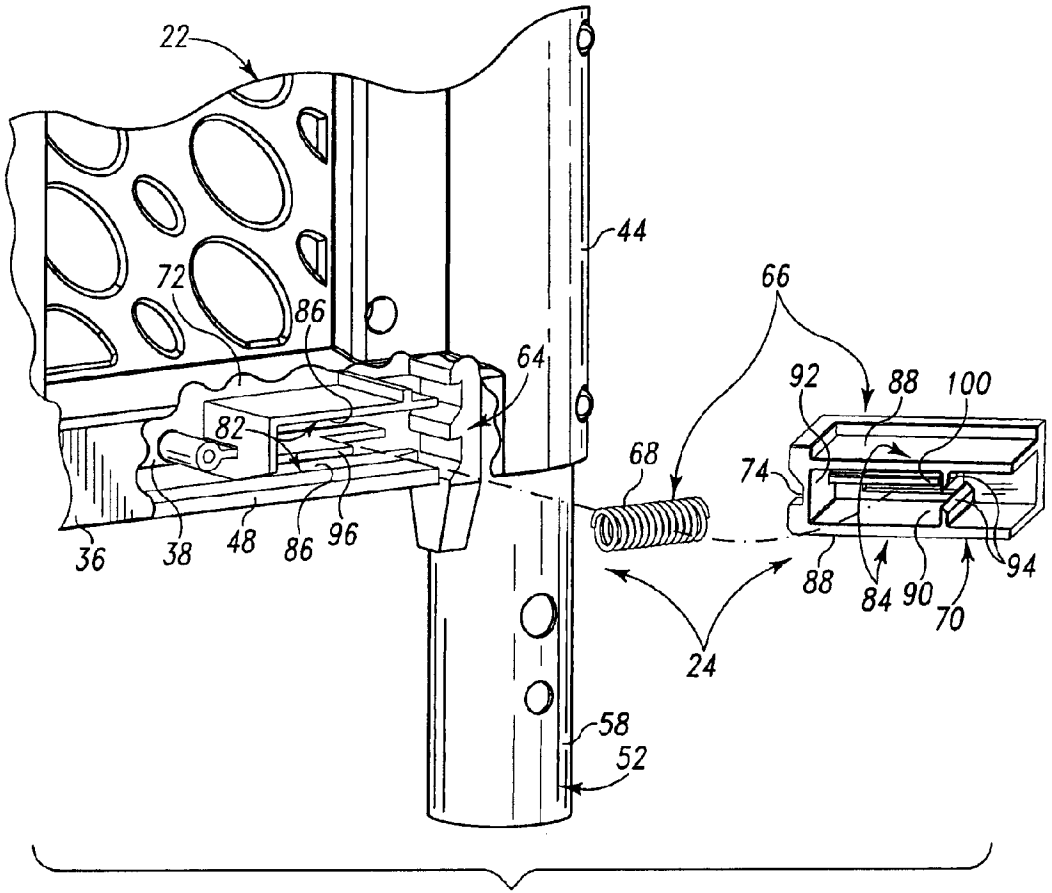
FIG. 4 is a partially exploded perspective view, with portions broken away, showing the right motion controller further including a ratchet coupled to the leg and a ratchet engagement device including a body configured to engage the ratchet and a mover (e.g., a spring) configured to move the body into engagement with the ratchet.
Figure 3:
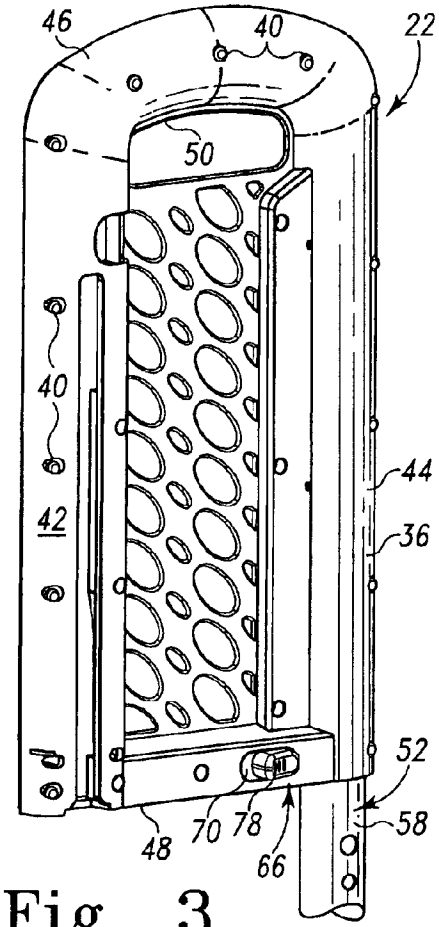
FIG. 3 is a perspective view of the right clamp, with portions broken away, showing the right movable jaw supported by a leg included in the right motion controller.

Movable jaw 22 includes inner and outer shells 36, 38 coupled to one another by fasteners 40, as shown, for example, in FIGS. 3 and 4. Inner and outer shells 36, 38 cooperate to provide a forward portion 42 of movable jaw 22, a rearward portion 44 of movable jaw 22, a top portion 46 of movable jaw 22, and a bottom portion 48 of movable jaw 22. Side rail 18 is coupled to forward portion 42 for movement relative thereto. Rearward portion 44 is coupled to motion controller 24. Top portion 46 is formed to include a hand grip 50 configured to be gripped by a person's hand to push movable jaw 22 downwardly toward fixed jaw 20 for engagement between bottom portion 48 and mattress 16.

Figures 5, 6, 7:
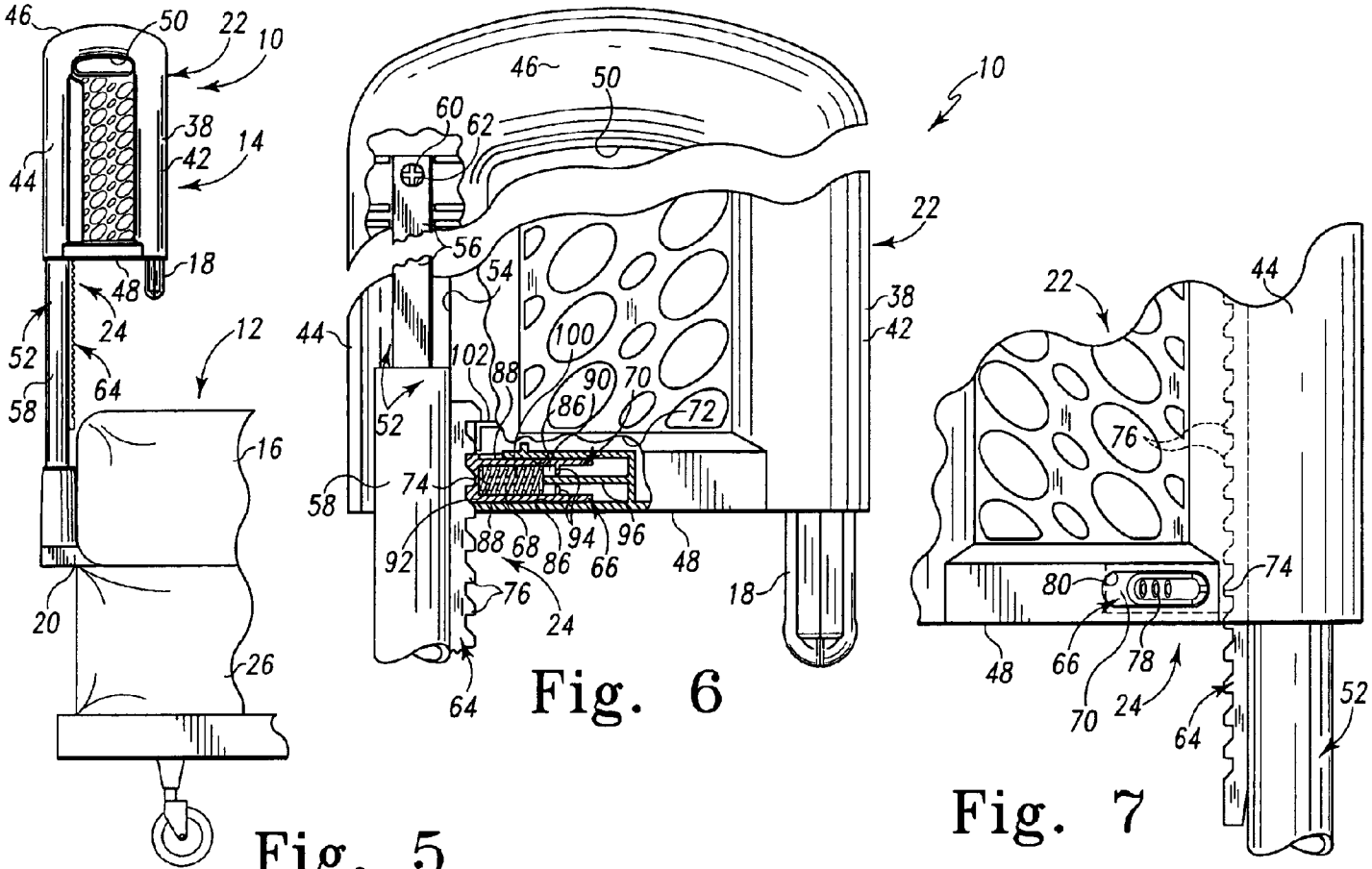
FIG. 5 is an end elevation view of the bed rail showing the right fixed jaw extending between the mattress and an underlying box spring unit and showing the right movable jaw elevated above the mattress and ready for downward movement to clamp the mattress between the right fixed jaw and the right movable jaw.
FIG. 6 is an enlarged end elevation view of the bed rail, with portions broken away, corresponding to the condition shown in FIG. 5 and showing the body of the right motion controller positioned in a motion-limiting position in which the body engages the ratchet of the right motion controller to block upward movement of the right movable jaw away from the right fixed jaw and, in the absence of application of an elevation adjustment force to the right movable jaw, to block downward movement of the right movable jaw toward the fixed jaw to position the right movable jaw and the side rail coupled thereto at a selected elevation.
FIG. 7 is an elevation view of an inner side of the right clamp, with portions broken away, corresponding to the condition shown in FIGS. 5 and 6 and showing the body in its motion-limiting position.
Figure 10:
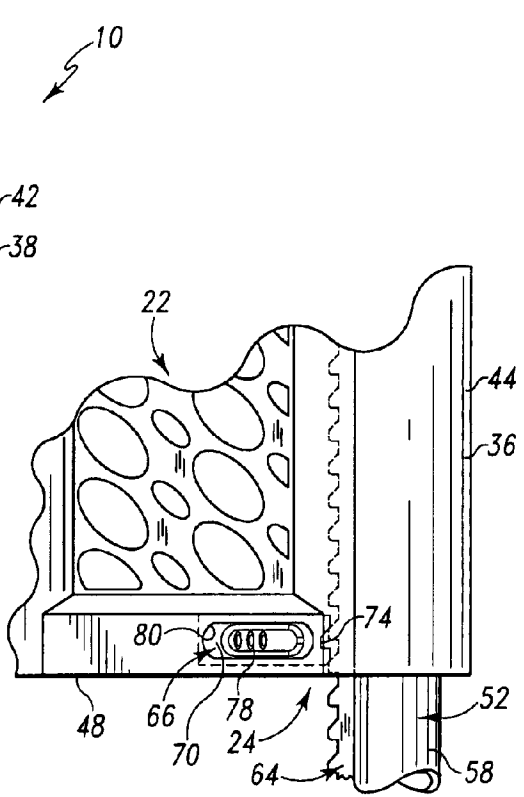
FIG. 10 is an elevation view of the inner side of the right clamp, with portions broken away, corresponding to the condition shown in FIGS. 8 and 9 and showing movement of the body of the right motion controller due to camming engagement between the body and the ratchet during downward movement of the right movable jaw.
Figure 8:
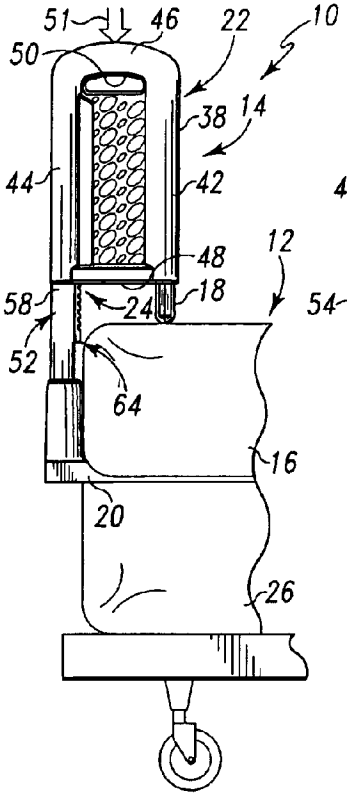
FIG. 8 is an end elevation view of the bed rail showing downward movement of the right movable jaw toward the right fixed jaw and the mattress upon application of the elevation adjustment force to the right movable jaw.
Figure 13:
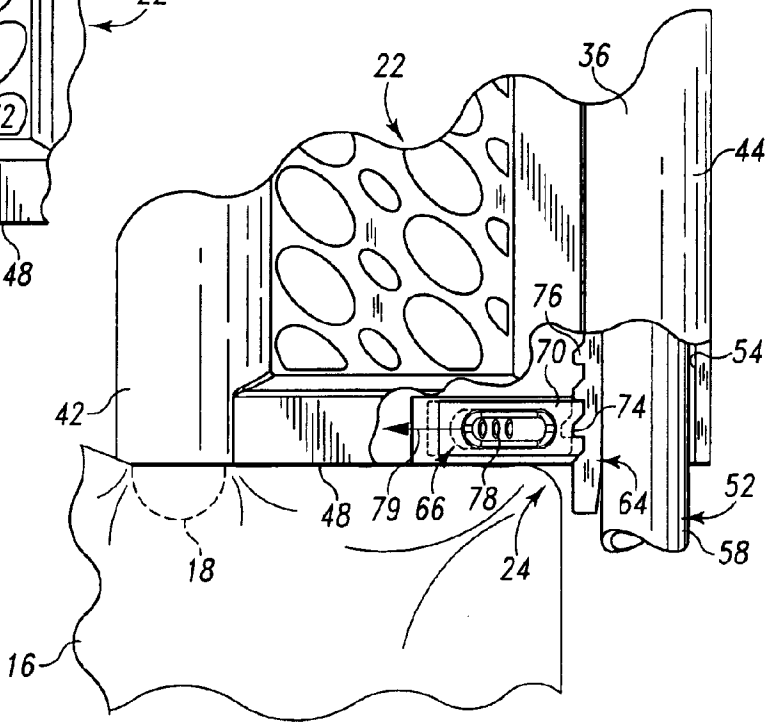
FIG. 13 is an elevation view of the inner side of the right clamp, with portions broken away, corresponding to the condition shown in FIGS. 11 and 12 and showing, in solid lines, the body assuming its motion-limiting position so that the mattress remains clamped and, in phantom, the body assuming a motion-enabling position upon application of a release force to a release coupled to the body to allow upward movement of the right movable jaw away from the right fixed jaw to unclamp the mattress.

Motion controller 24 is configured to move between a motion-limiting position shown, for example, in FIG. 6 and a motion-enabling position shown, for example, in phantom lines in FIG. 13. In the motion-limiting position, motion controller 24 blocks movement of movable jaw 22 away from fixed jaw 20 and, in the absence of application of an elevation adjustment force 51 to movable jaw 22, also blocks movement of movable jaw 22 toward fixed jaw 20 to position movable jaw 22 and side rail 18 coupled thereto at a selected elevation. Motion controller 24 allows movement of movable jaw 22 toward fixed jaw 20 to clamp mattress 16 upon application of elevation adjustment force 51 to movable jaw when motion controller 24 is positioned in the motion-limiting position, as suggested in FIGS. 8–10. In the motion-enabling position, motion controller 24 allows movement of movable jaw 22 toward fixed jaw 20 and allows movement of movable jaw 22 away from fixed jaw 20 to unclamp mattress 16.

Motion controller 24 includes a leg 52 shown, for example, in FIGS. 1 and 6 and a guide channel 54 shown, for example, in FIG. 6. Leg 52 extends from fixed jaw 20 into guide channel 54. Guide channel 54 is formed in inner and outer shells 36, 38 of movable jaw 22 and configured to guide movement of movable jaw 22 along leg 52.

Figure 9:
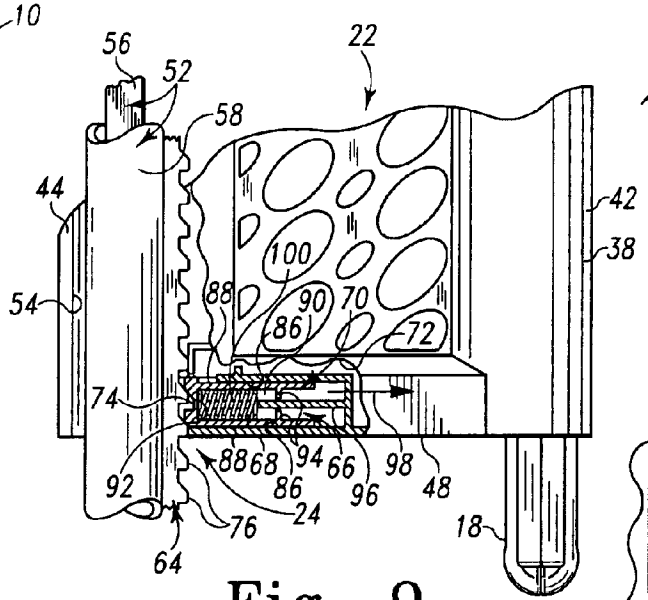
FIG. 9 is an enlarged end elevation view of the bed rail, with portions broken away, corresponding to the condition shown in FIG. 8 and showing camming engagement between the body and the ratchet to allow downward movement of the right movable jaw upon application of the elevation adjustment force to the right movable jaw.
Figure 12:
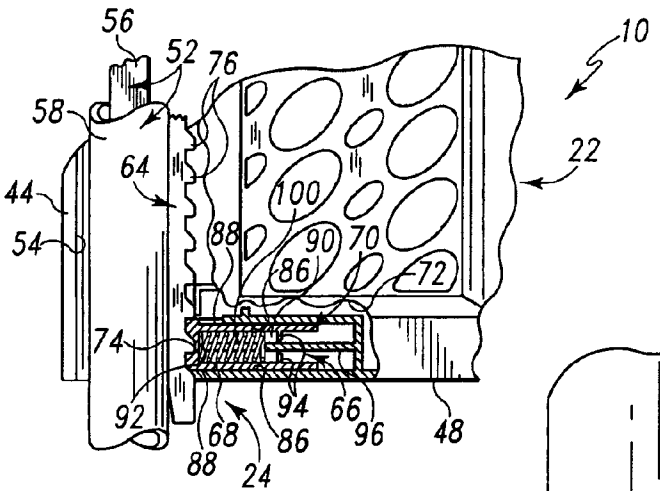
FIG. 12 is an enlarged end elevation view of the bed rail, with portions broken away, corresponding to the condition shown in FIG. 11.

In the illustrated embodiment, leg 52 includes telescoping inner and outer tubes 56, 58, as shown, for example, in FIGS. 6, 9, and 12. Inner tube 56 is coupled to movable jaw 22 by a tube mount 60 which extends into an aperture 62 formed in an upper end portion of inner tube 56, as shown, for example, in FIG. 6.

Motion controller 24 includes a ratchet 64 and a ratchet engagement device 66, as shown, for example, in FIGS. 4, 6, 7, 9, 10, 12, and 13. Ratchet 64 is coupled to outer tube 58. Ratchet engagement device 66 is coupled to movable jaw 22 for movement relative to ratchet 64 between the motion-limiting position in which device 66 engages ratchet 64 and the motion-enabling position in which device 66 releases ratchet 64. Device 66 thus provides means for engaging ratchet 64 to clamp mattress 16 and for releasing ratchet 64 to unclamp mattress 16.

Device 66 includes a slidable body 70, a mover 68, and a release 78, as shown, for example, in FIGS. 3 and 4. Body 70 is positioned in a jaw interior region 72 formed in movable jaw 22 and is formed to include a notch member 74 configured to receive teeth 76 included in ratchet 64. Mover 68 moves body 70 toward ratchet 64 to the motion-limiting position and is configured, for example, as a spring.

Release 78 is coupled to body 70 to move body to the motion-enabling position upon application of a release force 79 to release 78 by a user. Release 78 is configured, for example, as a lug extending from body 70 through an exterior access opening 80 formed in inner shell 36 for external access to release 78 by the user. Body 70 and release 78 cooperate to provide a button.

Body 70 is configured to slide between the motion-limiting and motion-enabling positions. Movable jaw 22 includes a guide 82 and body 70 includes a guide follower 84 configured to follow 82, as shown, for example, in FIG. 4. Guide 82 includes upper and lower guide surfaces 86. Follower 84 includes upper and lower follower surfaces 88 configured to slide against upper and lower guide surfaces 86 for linear movement of body 70.

Spring 68 is positioned in a body interior region 90 shown, for example, in FIG. 4. Spring 68 is captured between a spring retention surface 92 positioned to one side of spring 68 and a pair of spring retention tabs 94 positioned to an opposite side of spring 68. Spring retention tabs 94 are mounted in spaced-apart relation to one another to receive a spring compression tab 96 therebetween.

Spring compression tab 96 is included in movable jaw 22 and configured to extend between spring retention tabs 94 to engage spring 68 for compression thereof upon movement of body 70 in a direction 98, as shown, for example, in FIG. 9. Such movement may occur due to camming engagement between notch member 74 and teeth 76 and may occur due to application of release force 79 to release 78 to move body 70 to the motion-enabling position.

A spring alignment tab 100 shown, for example, in FIG. 4 is configured to align spring 68 with spring compression tab 96 for engagement therewith. Spring alignment tab 100 is coupled to body 70 to extend in body interior region 90 and extends longitudinally along spring 68 for engagement with spring 68.

To use bed rail 10, bed rail 10 is first coupled to bed 12. To couple bed rail 10 to bed 12, right and left clamps 14, 114 are clamped to mattress 16. Side rail 18 is mounted alongside bed 12 upon clamping of clamps 14, 114 to bed 12. Each clamp 14, 114 thus provides means for clamping mattress 16 to position side rail 18 alongside mattress 16.

Before clamping of mattress 16, fixed jaws 20, 120 are inserted between mattress 16 and box spring unit 26 and side rail 18 and movable jaws 22, 122 are positioned at an elevated position over mattress 16 in a mattress-unclamping position, as shown, for example, in FIG. 5. Each body 70 is positioned in its motion-limiting position, as shown, for example, in FIGS. 6 and 7, to maintain side rail 18 and movable jaws 22, 122 in the elevated position.

Figure 11:
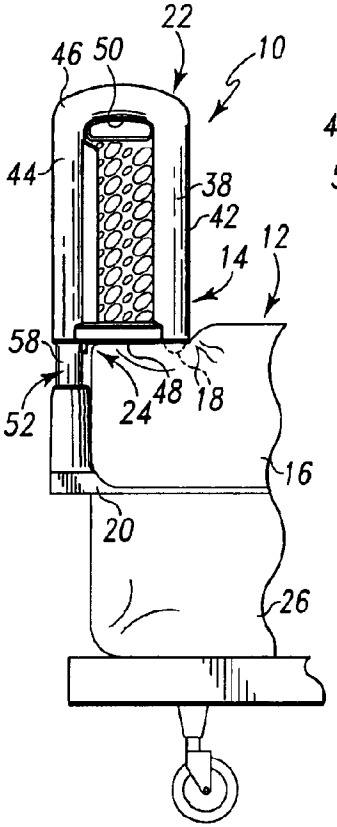
FIG. 11 is an end elevation view of the bed rail showing the right movable jaw and the right fixed jaw clamping the mattress therebetween.

Clamps 14, 114 are then clamped to mattress 16. Elevation adjustment force 51 is applied to each hand grip 51 to lower side rail 18 and movable jaws 22, 122 into contact with mattress 16 to apply a clamping force thereto, as shown, for example, in FIG. 8. Bodies 70 cam against teeth 76 of ratchets 64 to allow lowering of side rail 18 and movable jaws 22, 122, a shown in FIGS. 9 and 10. Further downward movement of side rail 18 and movable jaws 22, 122 causes movable jaws 22, 122 to assume a mattress-clamping position so that mattress 16 becomes clamped between movable jaws 22, 122 and fixed jaws 20, 120, as shown in FIG. 11. When mattress 16 is clamped, bodies 70 are in their motion-limiting position to block upward movement of movable jaws 22, 122 to lock movable jaws 22, 122 in their mattress-clamping position, as shown in FIGS. 12 and 13.

To unclamp mattress 16, release force 79 is applied to releases 78, as shown, for example, in FIG. 13. Release force 79 moves bodies 70 from the motion-limiting position to the motion-enabling position to allow elevation of side rail 18 and movable jaws 22, 122 away from mattress 16 back to a mattress-unclamping position shown, for example, in FIG. 5. An elevation limiter 102 shown, for example, in FIG. 6, is coupled to each outer shell 38 to engage a ratchet 64 to limit elevation of side rail 18 and movable jaws 22, 122.

Figure 14:
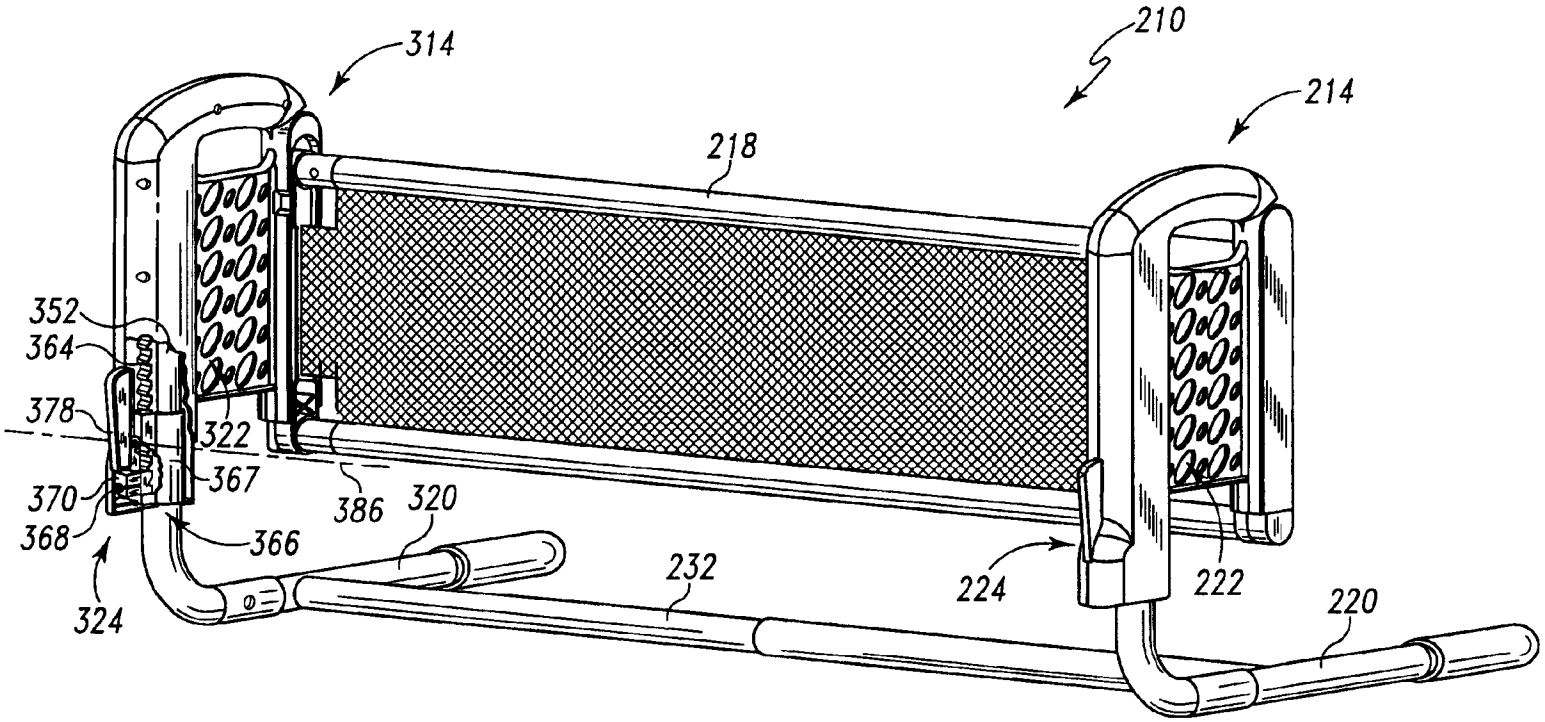
FIG. 14 is a perspective view of another bed rail which includes left and right clamps coupled to a side rail extending therebetween.

A bed rail 210 shown, for example, in FIG. 14 is configured for use with bed 12. Bed rail 210 includes right and left clamps 214, 314 configured to clamp mattress 16 to mount a side rail 218 alongside mattress 16 and to unclamp mattress 16. Each clamp 24, 314 thus provides means for clamping mattress 16 to position side rail 18 alongside mattress 16.

Right clamp 214 includes a right fixed jaw 220, a right movable jaw 222, and a right motion controller 224. Similarly, left clamp 314 includes a left fixed jaw 320, a left movable jaw 322, and a left motion controller 324. Fixed jaws 220, 320 are connected by a jaw connector 232 and are configured to be positioned under mattress 16 in a fixed position between mattress 16 and underlying box spring unit 26.

Movable jaws 222, 322 are coupled to side rail 218 and configured to be positioned over mattress. Movable jaws 222, 322 are configured to move toward fixed jaws 220, 320 to move side rail 218 toward mattress 16 to clamp mattress 16 between side rail 218 and fixed jaws 220, 320 to mount side rail 218 alongside mattress 16. Movable jaws 222, 322 are configured to move away from fixed jaws 220, 320 to move side rail 218 away from mattress 16 to unclamp mattress 16.

Right motion controller 224 is configured to control relative movement between right fixed jaw 220 and right movable jaw 222. Right motion controller 224 thus provides motion controller means for controlling relative movement between jaws 220, 222 toward one another to clamp mattress 16 and away from one another to unclamp mattress 16.

Left motion controller 324 is configured to control relative movement between left fixed jaw 320 and left movable jaw 322. Left motion controller 324 thus provides motion controller means for controlling relative movement between jaws 320, 322 toward one another to clamp mattress 16 and away from one another to unclamp mattress 16.

Clamps 214, 314 are similar to one another in structure and function. Thus, the description herein of left clamp 314 applies also to right clamp 214.

Figure 15:
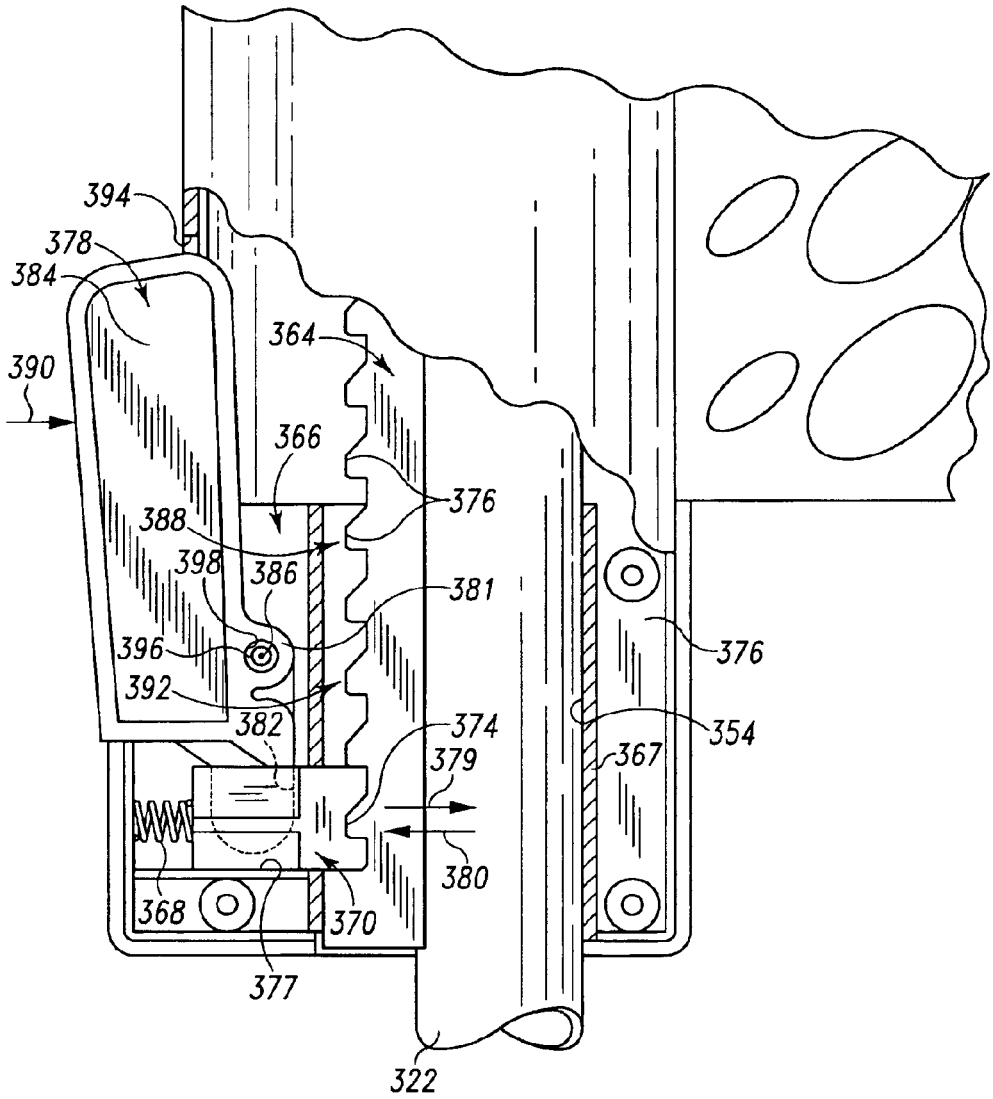
FIG. 15 is an elevation view, with portions broken away, showing components of the left clamp.

Motion controller 324 includes a leg 352, a ratchet 364, and a ratchet engagement device 366, as shown, for example, in FIG. 15. Leg 352 is coupled to and extends upwardly from fixed jaw 320 into an interior region 372 formed in movable jaw 322. Ratchet 364 is coupled to leg 352. A sleeve 367 is positioned in interior region 372 to receive and surround leg 352 and ratchet 364 coupled thereto. Sleeve 367 is formed to include a guide channel 354 to guide movement of movable jaw 322 along leg 352.

Ratchet engagement device 366 is coupled to movable jaw 322 for movement therewith as movable jaw 322 moves toward and away from fixed jaw 320. Ratchet engagement device 366 includes a slidable body 370, a mover 368, and a release 378.

Mover 368 causes body 370 to slide along a surface 377 toward ratchet 364 in a ratchet-engagement direction 379 to a motion-limiting position so that body 370 normally engages ratchet 364. Engagement between body 370 and ratchet 364 allows movement of movable jaw 322 toward fixed jaw 320 to clamp mattress 16 but blocks movement of movable jaw 322 away from fixed jaw 320. Body 370 is formed to include a notch member 374 to engage teeth 376 included in ratchet 364. Mover 368 is configured, for example, as a spring.

Release 378 is configured to cause body 370 to slide along surface 377 away from ratchet 364 in a ratchet-release direction 380 to a motion-enabling position so that body 370 releases ratchet 364. Movable jaw 322 is allowed to move away from fixed jaw 320 to unclamp mattress 16 upon release of ratchet 364.

Release 378 includes a pivot 381, a body engagement tab 382, and an actuator tab 384. Pivot 381 is formed to include an axle-receiving opening 398 receiving an axle 396 for pivotable movement of release 378 about an axis 386. Body engagement tab 382 engages body 370 to move body 370 in ratchet-release direction 380 upon movement of actuator tab 384 through an external access opening 394 formed in movable jaw 322 in a first pivot direction 388 about axis 386 due to application of a release force 390 to actuator tab 384. Release force 390 may be applied to actuator tab 384 when the hand of a user grips a lower portion of movable jaw 320 so that the palm of the user's hand presses actuator tab 384 in first pivot direction 388. Release 378 will pivot about axis 386 through opening 394 in a second pivot direction 392 due to operation of mover 368 and engagement between body engagement tab 382 and body 370 when the user's hand is removed from actuator 384. Release 378 is configured, for example, as a plate.

Ratchet engagement device 366 provides means for engaging ratchet 364 to clamp mattress 16 and for releasing ratchet 364 to unclamp mattress 16.

What is claimed is:

1. A bed rail comprising a side rail and means for clamping a mattress to mount the side rail alongside the mattress, the clamping means including a left clamp and a right clamp, wherein each clamp includes a fixed jaw configured to be positioned under the mattress, a movable jaw configured to be positioned over the mattress and to move relative to the fixed jaw to clamp the mattress between the fixed jaw and the movable jaw and a motion controller configured to control relative movement of the jaws toward one another to clamp the mattress therebetween and away from one another to unclamp the mattress, the motion controller including a ratchet and a ratchet engagement device arranged to engage the ratchet to allow relative movement of the jaws toward one another but not away from one another and to release the ratchet to allow relative movement of the jaws away from one another.

2. The bed rail of claim 1, wherein the clamping means includes a left clamp and a right clamp, each clamp includes a fixed jaw configured to be positioned under the mattress and a movable jaw configured to be positioned over the mattress and to move relative to the fixed jaw to clamp the mattress between the fixed jaw and the movable jaw, and the side rail is coupled to the movable jaws for movement relative to the fixed jaws upon movement of the movable jaws.

3. The bed rail of claim 1, wherein the motion controller includes a leg extending between the jaws and the ratchet is coupled to the leg.

4. The bed rail of claim 3, wherein the leg extends into a channel formed in a first of the jaws and is coupled to a second of the jaws and the ratchet engagement device is coupled to the first jaw for movement relative thereto.

5. The bed rail of claim 1, wherein the ratchet engagement device is coupled to one of the jaws for movement relative to the ratchet.

6. The bed rail of claim 1, wherein the ratchet engagement device includes a body arranged to move on a first of the jaws axially toward and away from the ratchet and a spring urging the body toward the ratchet.

7. The bed rail of claim 1, wherein the ratchet engagement device includes a lug coupled to the body to move the body away from the ratchet against the spring upon application of a release force to the lug.

8. The bed rail of claim 1, wherein the ratchet engagement device includes a release coupled to the first jaw for pivotable movement relative thereto to move the body away from the ratchet against the spring.

9. A bed rail comprising a side rail and means for clamping a mattress to mount the side rail alongside the mattress, the clamping means including a left clamp and a right clamp, wherein each clamp includes a fixed jaw configured to be positioned under the mattress, a movable jaw configured to be positioned over the mattress and to move relative to the fixed jaw to clamp the mattress between the fixed jaw and the movable jaw, and a motion controller including a ratchet, a body that is mounted for movement relative to the ratchet between a motion-limiting position in which the body engages the ratchet to block movement of the movable jaw away from the fixed jaw and to allow movement of the movable jaw toward the fixed jaw upon application of an elevation adjustment force to the movable jaw and a motion-enabling position in which the body releases the ratchet to allow movement of the movable jaw toward and away from the fixed jaw, and a spring configured to move the body toward the ratchet, and the side rail is coupled to the movable jaws for movement relative to the fixed jaws upon movement of the movable jaws.

10. A bed rail comprising a side rail and a clamp coupled to the side rail and adapted to clamp a mattress to mount the side rail alongside the mattress, the clamp including a fixed jaw, a movable jaw, and a leg extending between the fixed jaw and the movable jaw, the fixed jaw being configured to be positioned under the mattress in a fixed position, the movable jaw receiving the leg in a channel formed in the movable jaw and being configured to be positioned over the mattress and to move along the leg relative to the fixed jaw to clamp the mattress between the fixed jaw and the movable jaw.

11. The bed rail of claim 10, wherein the side rail is coupled to the movable jaw to move relative to the fixed jaw upon movement of the movable jaw.

12. The bed rail of claim 10, wherein the clamp includes a ratchet coupled to the leg and a ratchet engagement device coupled to the movable jaw for movement relative to the ratchet to engage and release the ratchet.

13. A bed rail comprising a side rail and a clamp coupled to the side rail and adapted to clamp a mattress to mount the side rail alongside the mattress, wherein the clamp includes a ratchet and a ratchet engagement device configured to move relative to the ratchet to engage and release the ratchet and wherein the clamp includes a fixed jaw configured to be positioned under the mattress, a movable jaw configured to be positioned over the mattress and to move relative to the fixed jaw to clamp the mattress between the fixed jaw and the movable jaw.

14. A bed rail comprising a side rail and a clamp including a fixed jaw, a movable jaw coupled to the side rail, and a motion controller, the fixed jaw being configured to be positioned under a mattress in a fixed position, the movable jaw being configured to be positioned over the mattress and to move relative to the fixed jaw to clamp the mattress between the fixed jaw and the movable jaw, the motion controller being configured to move between a motion-limiting position blocking movement of the movable jaw away from the fixed jaw and allowing movement of the movable jaw toward the fixed jaw and a motion-enabling position allowing movement of the movable jaw away from the fixed jaw.

15. The bed rail of claim 14, wherein, in the motion-limiting position, the motion controller is configured to block movement of the movable jaw away from the fixed jaw and, in the absence of application of an elevation adjustment force to the movable jaw, to block movement of the movable jaw toward the fixed jaw to position the movable jaw and the side rail at a selected elevation and the motion controller is configured to allow movement of the movable jaw toward the fixed jaw upon application of the elevation adjustment force to the movable jaw.

16. The bed rail of claim 14, wherein the motion controller includes a ratchet and a body configured to move relative to the ratchet between the motion-limiting position in which the body engages the ratchet and the motion-enabling position in which the body releases the ratchet.

17. The bed rail of claim 16, wherein the motion controller includes a spring configured to move the body toward the ratchet.

18. The bed rail of claim 17, wherein the body is formed to include an interior region and includes a spring retention surface, a pair of spring retention tabs, and a spring alignment tab, the movable jaw includes a spring compression tab, the body is positioned in the interior region and captured between the spring retention surface which is located to one side of the spring and the spring retention tabs which are located to an opposite side of the spring, the spring retention tabs are spaced apart from one another to receive the spring compression tab therebetween for compression of the spring upon movement of the body from the motion-limiting position to the motion-enabling position, and the spring alignment tab extends longitudinally along the spring for engagement therewith to align the spring with the spring compression tab.

19. The bed rail of claim 14, wherein the motion controller includes a ratchet and means for engaging the ratchet to clamp the mattress and for releasing the ratchet to unclamp the mattress.

20. The bed rail of claim 14, wherein the motion controller includes a ratchet and a body configured to slide relative to the ratchet along the movable jaw between the motion-limiting position in which the body engages the ratchet and the motion-enabling position in which the body releases the ratchet.

21. The bed rail of claim 20, wherein the motion controller includes a mover configured to move the body toward the ratchet.

22. The bed rail of claim 20, wherein the motion controller includes a release configured to move the body to the motion-enabling position upon application of a release force to the release by a user.

23. The bed rail of claim 22, wherein the movable jaw is formed to include an interior region and an external access opening, the body is positioned in the interior region, and the release is a lug that is coupled to the body and extends through the external access opening for access to the lug by the user.

24. The bed rail of claim 22, wherein the release is coupled to the movable jaw for pivotable movement to move the body to the motion-enabling position.

25. The bed rail of claim 24, wherein the movable jaw is formed to include an interior region and an external access opening, the body is positioned in the interior region, the release is configured as a plate including a body engagement tab configured to engage the body and an actuator tab extending through the external access opening for application of the release force to the actuator tab by the user.

26. The bed rail of claim 25, wherein the movable jaw includes an axle and the plate is formed to include an axle-receiving opening that is positioned between the body engagement tab and the actuator tab and that receives the axle for pivotable movement of the plate about the axle.

27. The bed rail of claim 20, wherein the motion controller includes a leg extending between the fixed jaw and the movable jaw and a guide channel that is formed in the movable jaw and receives the leg to guide movement of the movable jaw along the leg and the ratchet is coupled to the leg.

28. The bed rail of claim 27, wherein the leg includes an outer tube and an inner tube positioned in the outer tube in telescoping relation therewith, the ratchet is coupled to the outer tube, and the inner tube is coupled to the movable jaw.

* * * * *